United States Patent [19]

Irwin et al.

[11] Patent Number: 4,998,516

[45] Date of Patent: Mar. 12, 1991

[54] INTERNAL COMBUSTION ENGINE WITH SILENCER SUPPORTED CARBURETOR CONTROL MEMBER

[75] Inventors: Gregory D. Irwin, Lindenhurst, Ill.; Norman C. Franke, Kenosha, Wis.

[73] Assignee: Outboard Marine Corporation, Waukegan, Ill.

[21] Appl. No.: 495,989

[22] Filed: Mar. 20, 1990

[51] Int. Cl.[5] ..... F02B 77/00

[52] U.S. Cl. ..... 123/198 E; 123/195 A

[58] Field of Search ..... 123/195 A, 195 P, 198 E; 181/214, 215, 229; 261/50.1, 64.6, 71; 440/84, 87

[56] References Cited

U.S. PATENT DOCUMENTS

| | | | |
|---|---|---|---|
| 2,764,393 | 9/1956 | Geyer | 261/64.6 |
| 3,831,567 | 8/1974 | Freismuth et al. | 261/64.6 |
| 3,837,322 | 9/1974 | Shishido et al. | 123/274 |
| 4,304,737 | 12/1981 | Breckenfeld et al. | 261/50.1 |
| 4,462,945 | 7/1984 | Brown | 261/50.1 |

*Primary Examiner*—Noah P. Kamen

*Attorney, Agent, or Firm*—Michael, Best & Friedrich

[57] ABSTRACT

Disclosed herein is an internal combustion engine comprising a carburetor having an air induction passage, a valve member located in the air induction passage and moveable between open and closed positions, and a fuel supply valve member moveable between open and closed positions, an air intake silencer communicating with the air induction passage and including spaced exterior brackets including aligned openings, an actuating member received in and support by the aligned openings for rotary and axial movement relative thereto, connected to one of the valve members for actuation of the one member between the open and closed positions in response to axial movement of the actuating member, and connected to the other of the valve members for actuation of the other member between the open and closed positions in response to rotary movement of the actuating member.

2 Claims, 1 Drawing Sheet

INTERNAL COMBUSTION ENGINE WITH SILENCER SUPPORTED CARBURETOR CONTROL MEMBER

BACKGROUND OF THE INVENTION

1. Field of the Art

The invention relates generally to internal combustion engines. More particularly, the invention relates to carburetor control for such internal combustion engines.

2. Reference to Prior Art

Attention is directed to U.S. Pat. No. 4,304,737 issued Dec. 8, 1989 and to U.S. Pat. No. 4,462,945, issued July 31, 1984. In both these patents, there is disclosed a carburetor including an air induction passage, a valve located in the air induction passage and operably movable between open and closed positions, and a fuel supply valve operably movable between open and closed positions.

Both of these patents also disclose a control rod which is mounted on the carburetor housing for both axial and rotary movement, and which is operably connected to the valve in the air induction passage to effect movement thereof between the open and closed positions in response to one of the axial and rotary movements and to the fuel supply valve to effect opening and closing movements thereof in response to the other of the axial and rotary movements.

U.S. Pat. No. 4,304,735 additionally specifies that the rod 42 is carried by a U-shaped support bracket 51 having one end or leg 52 fixed to the carburetor by the screws 55.

Attention is also directed to the following additional U.S. Pat. No. 3,837,322 issued on Sept. 24, 1974.

SUMMARY OF THE INVENTION

The invention provides an internal combustion engine comprising a carburetor having an air induction passage, a valve member located in the air induction passage and moveable between open and closed positions, and a fuel supply member moveable between open and closed positions, an air intake silencer communicating with the air induction passage and including spaced exterior brackets including aligned openings, an actuating member connected to one of the fuel supply and valve members for actuation of the one member between the open and closed positions in response to axial movement of the actuating member, and connected to the other of the fuel supply and valve members for actuation of the other member between the open and closed positions in response to rotary movement of the actuating member, and means on the air intake silencer for supporting the actuating member for rotary and axial movement.

The invention also provides an internal combustion engine comprising a carburetor having an air induction passage, a valve member located in the air induction passage and moveable between open and closed positions, and a fuel supply valve member moveable between open and closed positions, an air intake silencer communicating with the air induction passage and including spaced exterior brackets including aligned openings, and an actuating member received in and support by the aligned openings for rotary and axial movement relative thereto, connected to one of the valve members for actuation of the one member between the open and closed positions in response to axial movement of the actuating member, and connected to the other of the valve members for actuation of the other member between the open and closed positions in response to rotary movement of the actuating member.

A feature of the invention is to eliminate the usage of the support bracket 51 and screws 55 referred to in U.S. Pat. No. 4,304,737 by mounting a control rod by apertured brackets or legs extending integrally from an air silencer associated with the carburetor. Such construction is more economical than the previous constructions.

Other features and advantages of the invention will become apparent to those skilled in the art upon review of the following detailed description, claims, and drawings.

Figures 1, 2, 3:
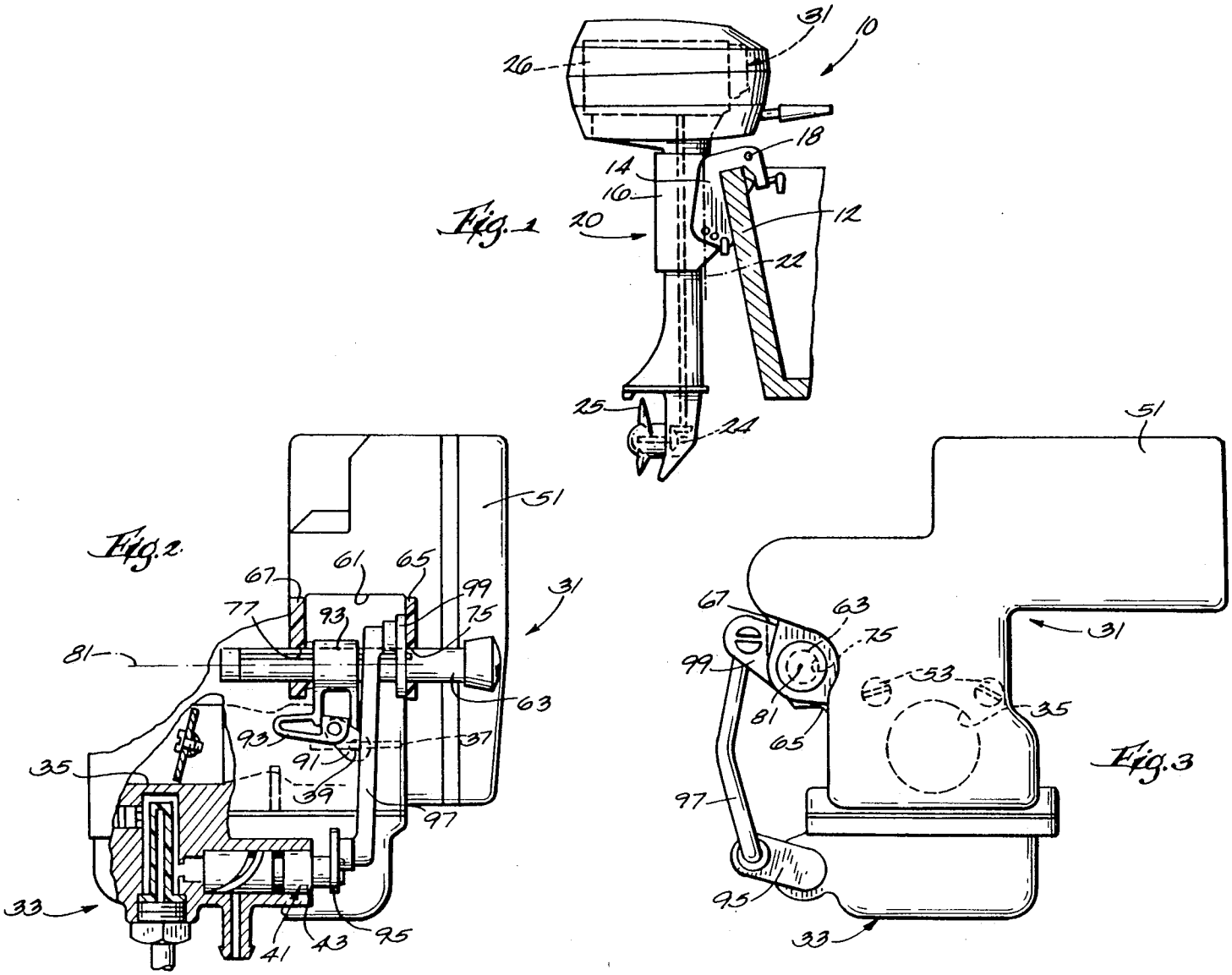
FIG. 1 is a side elevational view, partially in section, of a marine propulsion device embodying various of the features of the invention.
FIG. 2 is an enlarged side elevational view, partially broken away and in section, of a carburetor and air silencer assembly incorporated in the marine propulsion device shown in FIG. 1.
FIG. 3 is a front elevational view of the carburetor and air silencer assembly shown in FIG. 2.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in FIG. 1 is a marine propulsion device in the form of an outboard motor 10 which comprises a mounting assembly mounted on the transom 12 of a boat. While various suitable mounting assemblies can be used, in the illustrated construction, the mounting assembly includes a transom bracket 14 fixedly mounted on the transom 12, and a swivel bracket 16 mounted on the transom bracket 14 for pivotal movement relative thereto about a generally horizontal tilt axis 18.

The marine propulsion device or outboard motor 10 also comprises a propulsion unit 20 mounted on the swivel bracket 16 for pivotal movement relative thereto about a generally vertical steering axis 22, and for common movement therewith about the tilt axis 18. The propulsion unit 20 includes a rotatably mounted propeller shaft 24 carrying a propeller 25, and an internal combustion engine 26 (shown schematically in FIG. 1) drivingly connected to the propeller 25 by a conventional drive train 28.

The engine 26 includes a carburetor and air silencer assembly 31 including a carburetor 33 which can be of any conventional construction and which includes an air induction passage 35 having therein a choke or other valve member 37 carried by a shaft 39 which is rotatable so as to displace the valve member 37 between open and closed positions.

The carburetor 33 also includes a fuel shut off valve 41 which communicates with a source of fuel or fuel/oil mixture, which also communicates with one or more nozzles (not shown) for delivering fuel or fuel/oil mixture to the air induction passage 35, and which includes a valve member 43 moveable rotatably between open and closed positions.

The carburetor and air silencer assembly 31 also includes an air intake silencer 51 which, except as explained hereinafter, can be of any suitable construction. The air intake silencer 51 includes an air intake (not shown) and serves to communicate the air intake with the air induction passage 35. The air intake silencer 51 can be mounted in communication with the air induction passage 35 in any suitable manner. In the disclosed construction, the air intake silencer 51 is connected to the air induction passage 35 by a pair of screws 53 which pass through a flange (not shown) on the air intake silencer 51 and into a flange (not shown) formed at on the outer end of the air induction passage 35.

The air intake silencer 51 includes an exterior surface 61 and means on the exterior surface 61 for supporting an actuating member 63 for axial and rotary movement. While other constructions can be employed, in the disclosed construction, such support means comprises a pair of spaced lugs or brackets 65 and 67 which extend or project outwardly from the exterior surface 61 in spaced relation to each other and which respectively include aligned openings 75 and 77.

Received in and supported by the aligned openings 75 and 77 is the actuating member 63 which, in the disclosed construction, is elongated, which is bodily rotatable about an axis 81 of elongation, and which is also bodily axially moveable along the axis 81 of elongation.

Means are provided for connecting the actuating member 63 to the valve member 37 in the induction passage 35 and to the fuel supply valve member 43 for movement of one of the valve members 37 and 43 between its open and closed positions in response to one of the axial and rotary movements of the actuating member 63 and for movement of the other of the valve members 37 and 43 between its open and closed positions in response to the other of the axial and rotary movements of the actuating member 63.

Examples of suitable linkages are shown in U.S. Pat. Nos. 4,304,737 and 4,462,945 which are incorporated herein by reference. Any other suitable linkage can be employed. In the disclosed construction axial movement of the actuating member 63 causes rotary movement of the choke valve member 37 and rotational movement of the actuating member 63 causes rotational movement of the fuel supply valve member 43.

More particularly, the choke valve shaft 39 is fixedly connected to a crank 91 which, in turn, is pivotally connected to a resiliently fabricated lever 93 connected to the actuating member 63 by means for axially moving the lever 93 in response to axial movment of the actuating member 63 and for permitting rotary movement of the actuating member 63 relative the lever 93. Any suitable construction can be employed.

The fuel supply valve member 43 is fixedly connected to a crank 95 which, in turn, is pivotally connected to one end of a rod 97 which, at its other end, is pivotally connected to another crank 99 which is connected to the actuating member 63 by means for rotating the crank 99 in response to rotation of the actuating member 63 and for permitting axial movement of the actuating member 63 relative to the crank 99. Any suitable construction can be employed.

Withdrawal of the actuating member 63 from the lugs or brackets 65 and 67 in response to axial movement of the actuating member 63 is prevented by the connection of the lever 93 to the actuating member in a location between the lugs or brackets 65 and 67 by the means providing common axial movement of the actuating member 63 and the lever 93.

Various of the features of the invention are set forth in the following claims.

We claim:

1. An internal combustion engine comprising a carburetor having an air induction passage, a valve member located in said air induction passage and moveable between open and closed positions, and a fuel supply member moveable between open and closed positions, an air intake silencer communicating with said air induction passage, an actuating member connected to one of said fuel supply and valve members for actuation of said one member between said open and closed positions in response to axial movement of said actuating member, and connected to the other of said fuel supply and valve members for actuation of said other member between said open and closed positions in response to rotary movement of said actuating member, and means on said air intake silencer for supporting said actuating member for rotary and axial movement.

2. An internal combustion engine comprising a carburetor having an air induction passage, a valve member located in said air induction passage and moveable between open and closed positions, and a fuel supply valve member moveable between open and closed positions, an air intake silencer communicating with said air induction passage and including spaced exterior brackets including aligned openings, and an actuating member received in and supported by said aligned openings for rotary and axial movement relative thereto, connected to one of said valve members for actuation of said one member between said open and closed positions in response to axial movement of said actuating member, and connected to the other of said valve members for actuation of said other member between said open and closed positions in response to rotary movement of said actuating member.

* * * * *